US007946191B2

(12) United States Patent
Park

(10) Patent No.: US 7,946,191 B2
(45) Date of Patent: May 24, 2011

(54) ACCELERATOR PEDAL SYSTEM

(75) Inventor: Hangil Park, Hwaseong (KR)

(73) Assignee: Hyundai Motor Company, Seoul (KR)

( * ) Notice: Subject to any disclaimer, the term of this patent is extended or adjusted under 35 U.S.C. 154(b) by 1038 days.

(21) Appl. No.: 11/784,630

(22) Filed: Apr. 9, 2007

(65) Prior Publication Data

US 2008/0134830 A1 Jun. 12, 2008

(30) Foreign Application Priority Data

Dec. 8, 2006 (KR) ..... 10-2006-0125016

(51) Int. Cl.
*G05G 1/30* (2008.04)

(52) U.S. Cl. ..... 74/513; 74/512; 74/560

(58) Field of Classification Search ..... 74/512–514, 74/560; 701/36; 73/1.79; *G05G 1/14; B62K 26/02; F02D 11/10*
See application file for complete search history.

(56) References Cited

U.S. PATENT DOCUMENTS 5,408,899 A * 4/1995 Stewart ..... 74/513
5,529,296 A * 6/1996 Kato et al. ..... 267/155
6,745,642 B2 * 6/2004 Kumamoto et al. ..... 74/512
6,802,202 B2 * 10/2004 Kato et al. ..... 73/1.79
7,784,377 B2 * 8/2010 Park et al. ..... 74/513
2003/0236602 A1 * 12/2003 Kuge et al. ..... 701/36
2004/0149070 A1 * 8/2004 Solta ..... 74/513
2009/0064816 A1 * 3/2009 Kim et al. ..... 74/514

FOREIGN PATENT DOCUMENTS

JP 1-92537 4/1989
JP 10-83224 * 3/1998
JP 2004-114884 * 4/2004

* cited by examiner

*Primary Examiner* — Vinh T. Luong
(74) *Attorney, Agent, or Firm* — Morgan, Lewis & Bockius LLP

(57) ABSTRACT

An accelerator pedal system includes a vehicle speed sensor outputting a vehicle speed signal, an accelerator pedal, and a switch that generates a signal corresponding to at least one predetermined speed and a selected mode. An engine management system receives the signals from the vehicle speed sensor and the switch. A pedal control unit receives the vehicle speed signal and the switch signal, and outputs a control signal if a vehicle speed exceeds the predetermined speed. A reaction device is physically attached to the accelerator pedal and electrically connected to the pedal control unit. The reaction device applies force to the accelerator pedal based on the control signal.

4 Claims, 3 Drawing Sheets

ACCELERATOR PEDAL SYSTEM

CROSS-REFERENCE TO RELATED APPLICATION

This application claims priority to, and the benefit of, Korean Patent Application No. 10-2006-0125016, filed in the Korean Intellectual Property Office on Dec. 8, 2006, the entire contents of which are incorporated herein by reference.

BACKGROUND OF THE INVENTION (a) Field of the Invention

The present invention relates to an accelerator pedal system that warns a driver when a vehicle speed exceeds a predetermined limit speed by producing a change in reaction force of the accelerator pedal.

(b) Description of the Related Art

Typically, an accelerator pedal is connected with a throttle valve by a wire, such that an opening of the throttle valve changes based on position of the accelerator pedal. Alternatively, the opening of the throttle valve is changed by an actuator electrically coupled with the accelerator pedal. It would be desirable to provide an alarm device to warn the driver of dangerous situations or excessive speeds.

The above information disclosed in this Background section is only for enhancement of understanding of the background of the invention and therefore it may contain information that does not form the prior art that is already known in this country to a person of ordinary skill in the art.

SUMMARY OF THE INVENTION

An accelerator pedal system includes a vehicle speed sensor outputting a vehicle speed signal, an accelerator pedal, and a switch that generates a signal corresponding to at least one predetermined speed and a selected mode. An engine management system receives the signals from the vehicle speed sensor and the switch. A pedal control unit receives the vehicle speed signal and the switch signal, and outputs a control signal if a vehicle speed exceeds the predetermined speed.

A reaction device is physically attached to the accelerator pedal and electrically connected to the pedal control unit. The reaction device applies force to the accelerator pedal based on the control signal.

The mode is selected from a first mode, in which the reaction device applies a first, greatest reaction force to the accelerator pedal; a second mode in which the reaction device applies a second, intermediate reaction force to the accelerator pedal; and a third mode in which the reaction device applies a third, smallest reaction force to the accelerator pedal.

The reaction device includes an actuator that operates in response to the control signal; a first operating member operated by the actuator to generate the reaction force; a second operating member that rotates with the accelerator pedal and receives the reaction force from the first operating member; and a main elastic member that biases the first operating member to a home position.

The first operating member includes first, second, and third elastic members. The first reaction force is generated by the first, second, and third elastic members, the second reaction force is generated by the first and second elastic members, and the third reaction force is generated by the first elastic member.

The first operating member also includes a first hook connected to the first elastic member, a second hook connected to the second elastic member, and a third hook connected to the third elastic member.

The reaction device also includes a wire interconnecting the actuator and the first operating member.

The actuator includes a motor or an electromagnet.

DETAILED DESCRIPTION OF THE PREFERRED EMBODIMENTS

An exemplary embodiment of the present invention will hereinafter be described in detail with reference to the accompanying drawings.

The term "reaction force" in this specification is used to denote a force that acts on an accelerator pedal in the direction of its home position, that is, a force that pushes the accelerator pedal opposite the direction in which it is pushed by a driver to accelerate a vehicle.

Figure 1:
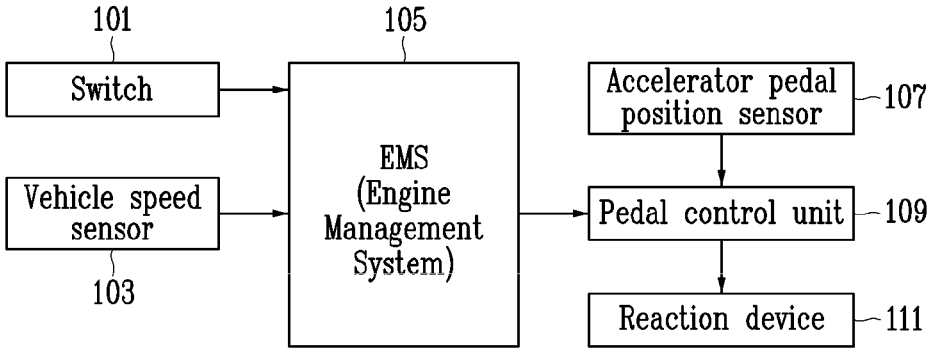
FIG. 1 is a schematic view of an accelerator pedal system according to an exemplary embodiment of the present invention.
Figure 2:
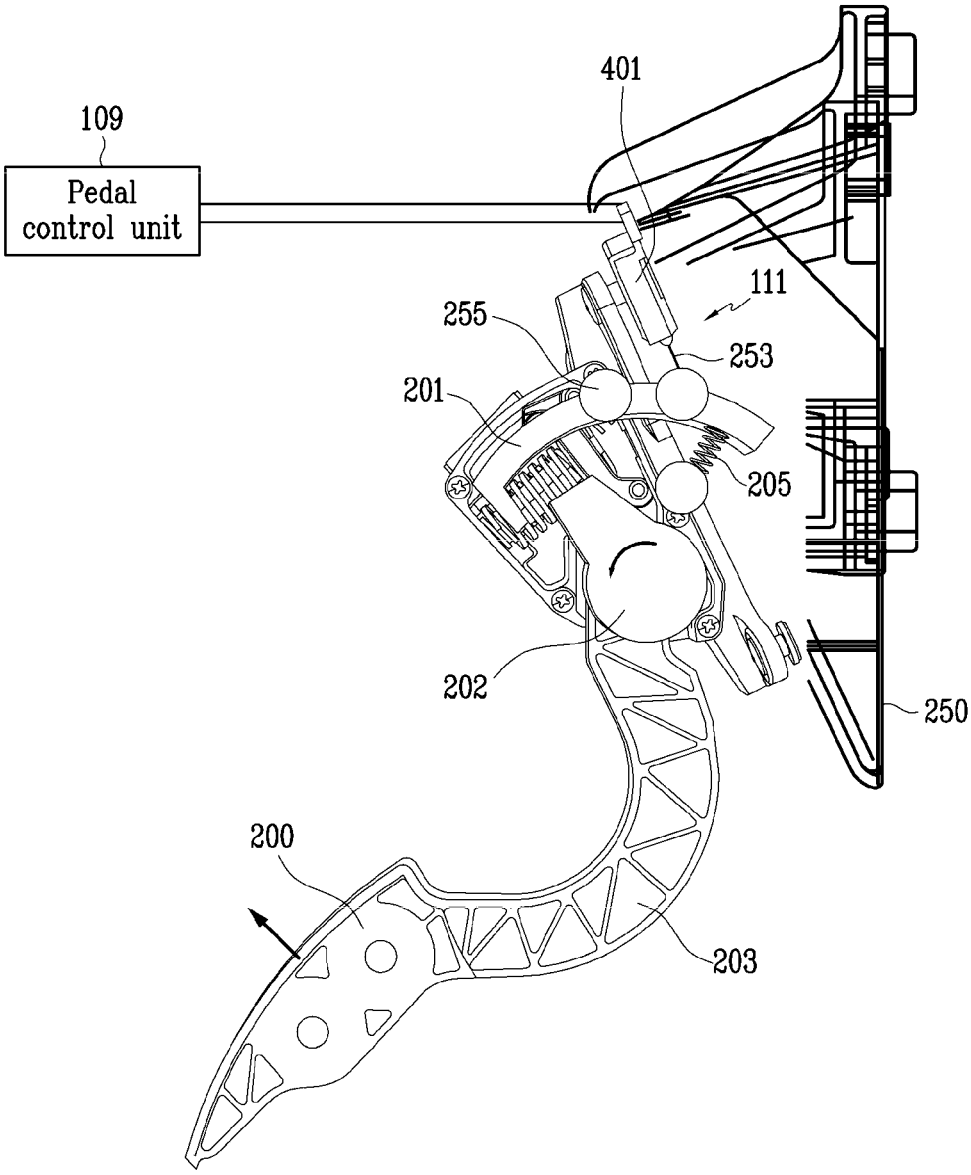
FIG. 2 is a side view of an accelerator pedal system according to an exemplary embodiment of the present invention.

As shown in FIG. 1 and FIG. 2, an accelerator pedal system according to an exemplary embodiment of the present invention includes a vehicle speed sensor 103, an accelerator pedal 200 connected to a rod 203, a switch 101, an accelerator pedal position sensor 107, an engine management system (EMS) 105, a pedal control unit 109, and a reaction device 111.

The switch 101 generates a signal corresponding to at least one predetermined speed, and a mode selected from a plurality of predetermined modes. The engine management system 105 receives signals from the vehicle speed sensor 103 and the switch 101. The accelerator pedal position sensor 107 detects an operating position of the accelerator pedal 200, and generates a corresponding signal.

The pedal control unit 109 receives the vehicle speed signal and the switch signal from the engine management system 105. When the vehicle speed exceeds the predetermined speed, the pedal control unit 109 outputs a control signal to the reaction device 111, which controls the accelerator pedal 200 according to the selected mode. The reaction device 111 may be disposed at an upper portion of the accelerator pedal 200 such that the reaction device 111 applies a reaction force to the accelerator pedal 200 in response to a movement of the accelerator pedal 200.

The switch 101 enables selection of the at least one predetermined speed, and selection of the desired mode. The predetermined speed is a speed that is deemed dangerous, and may be selected by a person of an ordinary skill in the art based on the teachings herein.

The modes are different ways of warning the driver that the vehicle speed exceeds the predetermined speed. They may, for example, be different ways of controlling the pedal reaction force of the accelerator pedal 200. According to an exemplary embodiment of the present invention, there are three modes, corresponding to three different reaction forces.

Since the switch 101 is operated by a driver, the desired mode can also be selected by the driver.

The engine management system 105 may be a conventional engine management system. According to an exemplary embodiment of the present invention, the engine management system 105 receives signals, from the vehicle speed sensor 103 and the switch 101 and outputs them to the pedal control unit 109. The pedal control unit 109 may include a processor, memory, and associated hardware, software, and/or firmware as may be selected and programmed by a person of ordinary skill in the art based on the teachings herein.

The accelerator pedal position sensor 107 detects a position of the accelerator pedal 200, and sends the detected pedal position to the pedal control unit 109.

According to an exemplary embodiment of the present invention, when the signal from the accelerator pedal position sensor 107 corresponds to a deep operation (e.g., over 85% of the stroke) of the accelerator pedal 200, or when the switch 101 is turned off, the accelerator pedal system suspends its operation.

The reaction device 111 may include an actuator 401, a first operating member 201, a second operating member 202, and a main elastic member 205.

The actuator 401 operates in response to a signal from the pedal control unit 109, and the first operating member 201 is operated by the actuator 401 so as to selectively generate the first, second, or third reaction force.

The second operating member 202 rotates with the accelerator pedal 200 and receives the first, second, and third reaction forces from the first operating member 201. The second operating member 202 is attached to an end of the rod 203.

The main elastic member 205 biases the first operating member 201 to its home position.

The actuator 401 may be fixed to a stationary position, such as to the vehicle body 250.

The first operating member 201, as shown in FIG. 2, may be arc-shaped, and is rotatably secured to a fixed element, such as the vehicle body 250, by a hinge 255.

Figure 3:
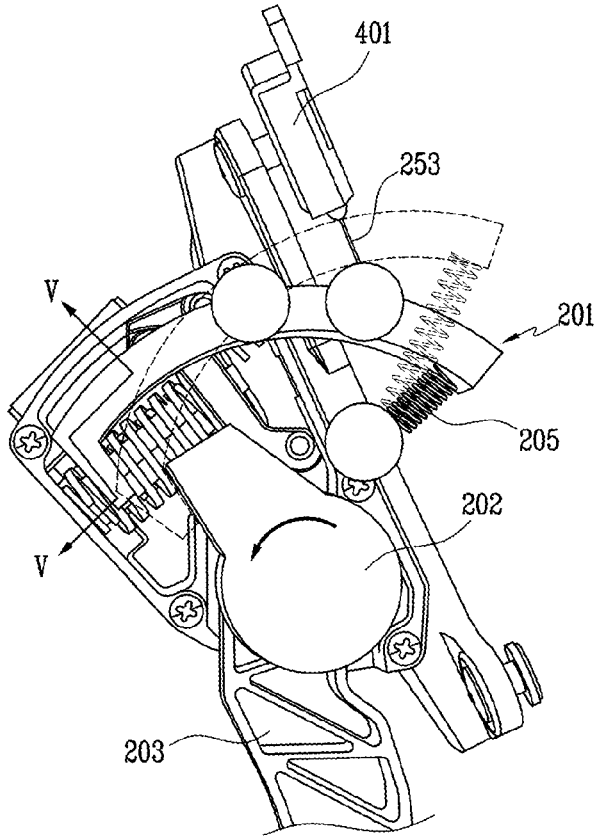
FIG. 3 and FIG. 4 illustrate operation of an accelerator pedal system according to an exemplary embodiment of the present invention.
Figure 4:
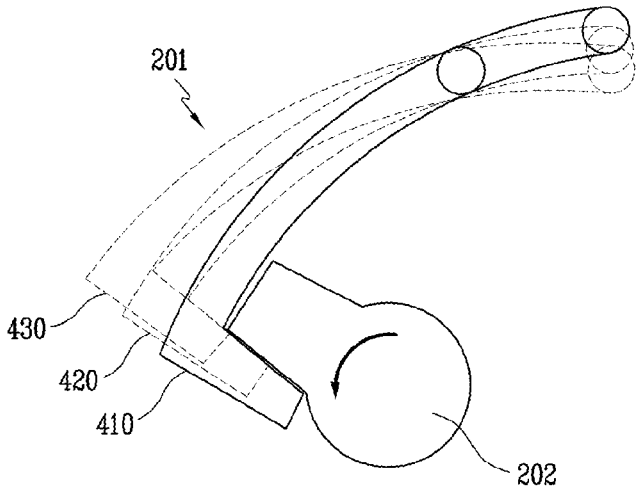
Figure 5:
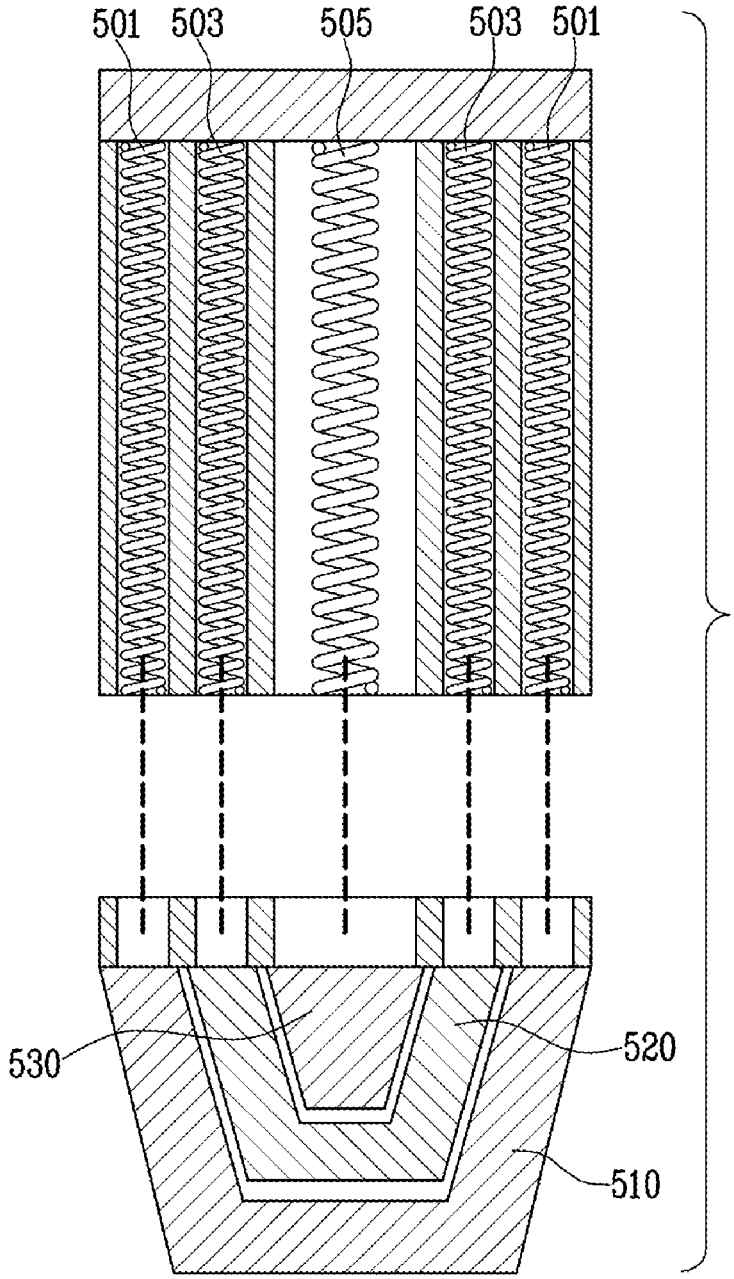
FIG. 5 is a cross-sectional view along line V-V in FIG. 3.

Referring to FIGS. 3-5, the first operating member 201 includes first, second, and third elastic members 501, 503, and 505 disposed therein. The first reaction force is generated by cooperative operation of the first, second, and third elastic members 501, 503, and 505. The second reaction force is generated by the first and second elastic members 501 and 503. The third reaction force is generated solely by the first elastic member 501.

The first operating member 201 also includes a first hook 510, connected to the first elastic member 501; a second hook 520, connected to the second elastic member 503; and a third hook 530, connected to the third elastic member 505.

Referring to FIGS. 2-4, if the driver depresses the accelerator pedal 200, the second operating member 202 rotates counterclockwise in the drawings. During this rotation, one of the first, second, and third hooks 510, 520, and 530 is operated corresponding to a position of the first operating member 201, and so the first, second, or third reaction force is applied to the second operating member 202.

The reaction device 111 further includes a wire 253 connecting the actuator 401 with the first operating member 201. If the actuator 401 is operated, the wire 253 rotates the first operating member 201 counterclockwise in the drawings.

The actuator 401 may be a motor or an electromagnet, and the rotating angle of the first operating member 201 may be controlled by controlling current applied to the actuator 401 by the pedal control unit 109.

Referring to FIG. 3 to FIG. 5, operation of an accelerator pedal system according to an exemplary embodiment of the present invention is described hereinafter.

FIG. 3 shows a state in which the reaction device 111 is not operated. The first operating member 201 does not contact the second operating member 202, although the second operating member 202 rotates.

According to an exemplary embodiment of the present invention, when the reaction device 111 does not operate and rotation of the second operating member 202 brings the first and second operating members 201 and 202 closest together, the distance therebetween is about 2 mm to 3 mm.

When a dangerous situation is detected, or when the vehicle speed exceeds the predetermined speed in a selected mode, the engine management system 105 receives a corresponding signal and outputs it to the pedal control unit 109.

The predetermined speed may be input by a radar sensor or a navigation system installed in the vehicle.

The predetermined dangerous situation may be detected by, for example, a vehicle navigation system or a front monitoring camera, and such a dangerous situation may be selected as a design choice by a person of an ordinary skill in the art based on the teachings herein.

When the pedal control unit 109 receives the signal, the pedal control unit 109 operates the reaction device 111. The wire 253 rotates the first operating member 201 counterclockwise in the drawings by the actuator 401.

As shown in FIG. 4, the rotating angle of the first operating member 201 can differ based on the magnitude of the current applied from the pedal control unit 109 to the actuator 401. Reference numeral 410 shows the first mode (i.e. the greatest reaction force), reference numeral 420 shows the second mode (i.e. an intermediate reaction force), and reference numeral 430 shows the third mode (i.e. the smallest reaction force).

That is, if the first reaction force is generated by the first mode, the first, second, and third elastic members 501, 503, and 505 are operated. The second operating member 202 rotates to reference numeral 410, thereby contacting with the first, second, and third hooks 510, 520, and 530. If the second reaction force is generated by the second mode, the first and second elastic members 501 and 502 are operated. The second operating member 202 rotates to reference numeral 420, thereby contacting with the first and second hooks 5 10 and 520. If the third reaction force is generated by the third mode, the first elastic member 501 is operated. The second operating member 202 rotates to reference numeral 430, thereby contacting with the first hook 510. The reaction force of the first, second, or third modes is transmitted to the accelerator pedal 200.

Since a plurality of reaction forces can be generated, a plurality of predetermined speeds may be set, and a driver can be warned of exceeding one of the predetermined speeds by different reaction forces on the accelerator pedal 200.

Therefore, the driver can feel the change of the reaction force of the accelerator pedal 200, warning him of a dangerous situation or of exceeding a speed limit.

According to an exemplary embodiment of the present invention, when the driver presses the accelerator pedal 200 more than a kick-down point (for example, more than 85% of the entire stroke of the accelerator pedal 200), or when the switch 101 is turned off, the accelerator pedal system is turned off. When the accelerator pedal system is turned off, the reaction device 111 returns to its home position as shown in FIG. 3.

That is, according to an exemplary embodiment of the present invention, the warning function can be turned off and a normal reaction force can be applied to the accelerator pedal 200. In addition, a plurality of warning modes, i.e. the first, second, and third modes, can be utilized.

According to an exemplary embodiment of the present invention, in a dangerous situation or when a driver exceeds a speed limit, the driver can be warned of such a situation. Therefore, safety while driving a vehicle can be enhanced.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An accelerator pedal system, comprising:

a vehicle speed sensor outputting a vehicle speed signal;

an accelerator pedal;

a switch that generates a signal corresponding to at least one predetermined speed and a selected mode;

an engine management system that receives the signals from the vehicle speed sensor and the switch;

a pedal control unit that receives the vehicle speed signal and the switch signal, and outputs a control signal if a vehicle speed exceeds the predetermined speed; and a reaction device physically attached to the accelerator pedal and electrically connected to the pedal control unit, wherein the reaction device applies force to the accelerator pedal based on the control signal;

wherein the mode is selected from a first mode in which the reaction device applies a first reaction force to the accelerator pedal, a second mode in which the reaction device applies a second reaction force to the accelerator pedal, and a third mode in which the reaction device applies a third reaction force to the accelerator pedal, wherein the first reaction force is greater than the second reaction force and the second reaction force is greater than the third reaction force;

wherein the reaction device comprises:

an actuator that operates in response to the control signal;

a first operating member operated by the actuator to generate the first, second, or third reaction force;

a second operating member configured to rotate with the accelerator pedal and to receive the first, second, or third reaction force from the first operating member; and a main elastic member that biases the first operating member to a home position;

wherein the first operating member comprises first, second, and third elastic members, and wherein the first reaction force is generated by the first, second, and third elastic members, the second reaction force is generated by the first and second elastic members, and the third reaction force is generated by the first elastic member; and wherein the first operating member further comprises a first hook connected to the first elastic member, a second hook connected to the second elastic member, and a third hook connected to the third elastic member.

2. The accelerator pedal system of claim 1, wherein the reaction device further comprises a wire that interconnects the actuator and the first operating member.

3. The accelerator pedal system of claim 1, wherein the actuator comprises a motor or an electromagnet.

4. The accelerator pedal system of claim 1, wherein the first, second, and third hooks are sequentially assembled with a predetermined gap.

* * * * *